US006494317B1

(12) United States Patent
Focke

(10) Patent No.: US 6,494,317 B1
(45) Date of Patent: Dec. 17, 2002

(54) CIGARETTE PACKAGE AND METHOD AND DEVICE FOR THE PRODUCTION THEREOF

(75) Inventor: Heinz Focke, Verden (DE)

(73) Assignee: Focke & Co (GmbH & Co.), Verden (DE)

( * ) Notice: Subject to any disclaimer, the term of this patent is extended or adjusted under 35 U.S.C. 154(b) by 0 days.

(21) Appl. No.: 09/674,076

(22) PCT Filed: Apr. 17, 1999

(86) PCT No.: PCT/EP99/02598

§ 371 (c)(1),
(2), (4) Date: Oct. 26, 2000

(87) PCT Pub. No.: WO99/58424

PCT Pub. Date: Nov. 18, 1999

(30) Foreign Application Priority Data

May 12, 1998 (DE) ..... 198 20 966

(51) Int. Cl.[7] ..... A24F 15/12
(52) U.S. Cl. ..... 206/271; 206/273
(58) Field of Search ..... 206/259, 264, 206/271, 273; 229/87.13

(56) References Cited

U.S. PATENT DOCUMENTS

| | | | |
|---|---|---|---|
| 1,755,579 | A | 4/1930 | Grupe |
| 1,900,389 | A | 3/1933 | Reed |
| 4,778,962 | A | 10/1988 | Shimada |

FOREIGN PATENT DOCUMENTS

| | | |
|---|---|---|
| CH | 352951 | 4/1961 |
| DE | 1611990 | 10/1951 |
| DE | 1053400 | 3/1959 |
| DE | 36 30 029 | 3/1987 |
| DE | 44 37 782 | 5/1996 |
| DE | 196 44 079 | 5/1998 |
| EP | 649797 | 4/1995 |
| EP | 709306 | 9/1995 |
| FR | 1498156 | 10/1967 |

*Primary Examiner*—David T. Fidei
(74) *Attorney, Agent, or Firm*—Sughrue Mion, PLLC

(57) ABSTRACT

Cigarette packs of the soft pack type of a (pack) shape (11) of paper, foil or the like which directly encases a group of cigarettes (32) with folding flaps or edge strips (34, 35) which are glued together. In order to protect the group of cigarettes (32) from unwanted discharged glue, a cover shape (36) is positioned within the pack (10) between the group of cigarettes (32) and the pack shape (11), i.e., in the area of a side wall (21) of edge strips (34, 35) which are glued together.

7 Claims, 5 Drawing Sheets

11
12
13
14
15
16
17
18
19
20
22
24
25
26
27
28
29
30
34
35
36
37
38
39
40
42
43
44
45

CIGARETTE PACKAGE AND METHOD AND DEVICE FOR THE PRODUCTION THEREOF

BACKGROUND OF THE INVENTION

The invention relates to a cigarette pack, preferably a soft pack of a pack shape made of paper, foil or the like which directly encases a group of cigarettes, and the pack shape comprises in the area of at least one pack wall, in particular an upright side wall, folding flaps or side strips which are glued together. Furthermore, the invention relates to a process and a device for manufacturing packs of said type.

If a cigarette pack, in particular a soft pack, is designed in such a manner that a shape which directly encases the cigarette group comprises folding flaps which are glued together, then there is a danger of glue particles being transferred to the cigarettes. This undesirable effect can occur in particular when the cigarette pack is made of one single pack shape. An example for this is given in the description and illustration of EP 649 797. A glue transfer can take place in particular in the area of an upright narrow side wall which is formed of glued together folding flaps or side strips.

SUMMARY OF THE INVENTION

It is an object of the invention to prevent a transfer of glue from a pack shape which directly encases a group of cigarettes to the latter.

This object is achieved by a cigarette pack being characterised in that in the area of glued together folding flaps or side strips between a group of cigarettes and a pack shape is arranged a cover to protect the cigarettes from glue. This cover is preferably made of a separate shape of thin material, in particular paper. In an advantageous embodiment in conjunction with a cigarette pack according to EP 649 797, an upright U-shaped folded shape is provided which covers the cigarette group preferably over the full height in the area of the side wall which comprises glue.

Furthermore, the shape can take over the function of a printed display, i.e. be printed on internally and/or externally, for example as a voucher for participation in a raffle or with information.

The shape is placed in the inventive position during manufacture of the cigarette pack. Accordingly, once a cigarette group to suit a pack has been established, the shape is placed against the pack group, in particular under U-shaped folds. Thereafter, the pack shape is folded around the group of cigarettes in a conventional manner.

BRIEF DESCRIPTION OF THE DRAWINGS

Further details of the inventive pack of cigarettes and of its manufacture will now be given in more detail, based on the drawings. Shown are, in FIG. 1: a cigarette pack of the soft pack type in its opened state in a perspective illustration.

DETAILED DESCRIPTION OF THE INVENTION

Figure 1:
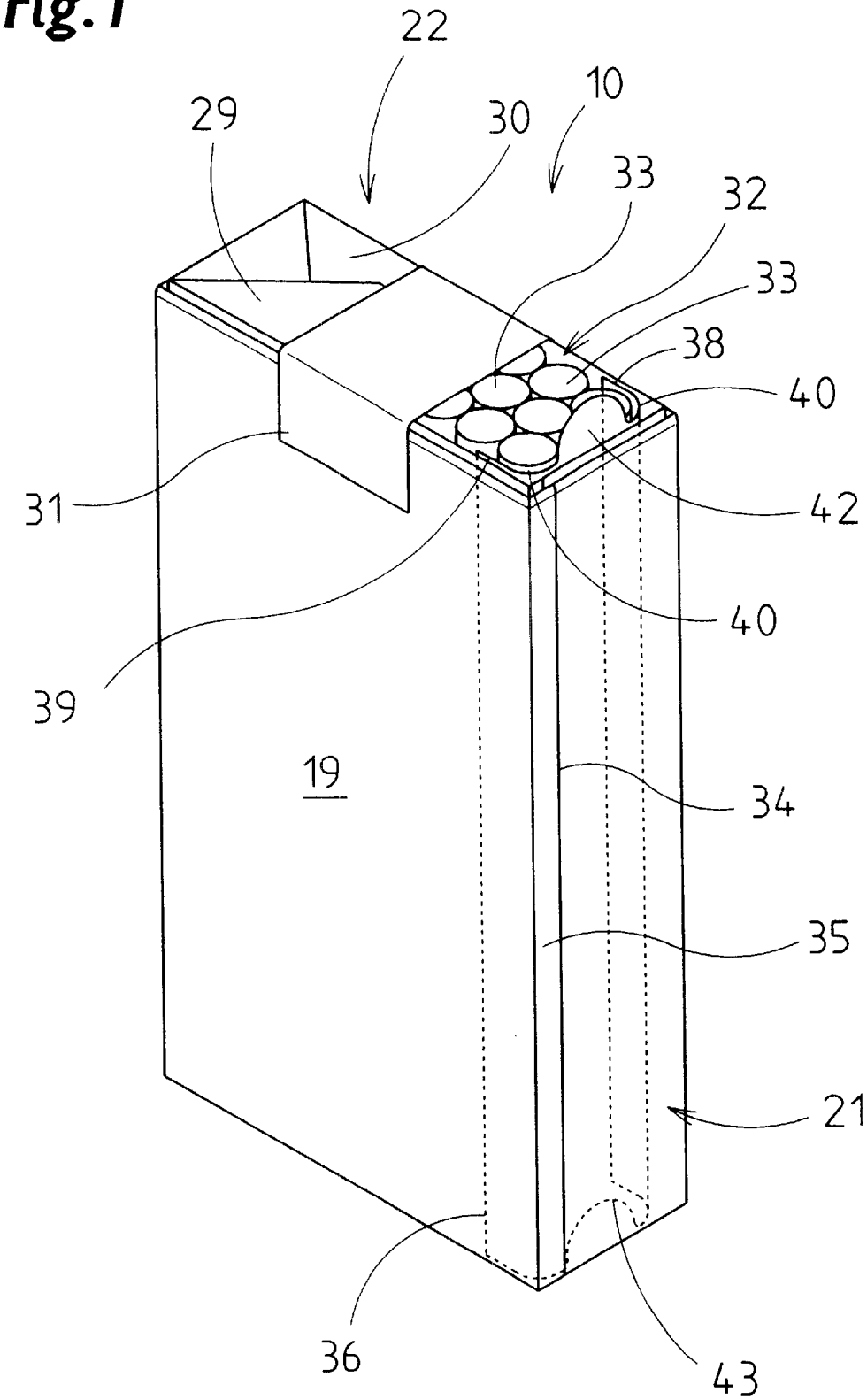
Figure 2:
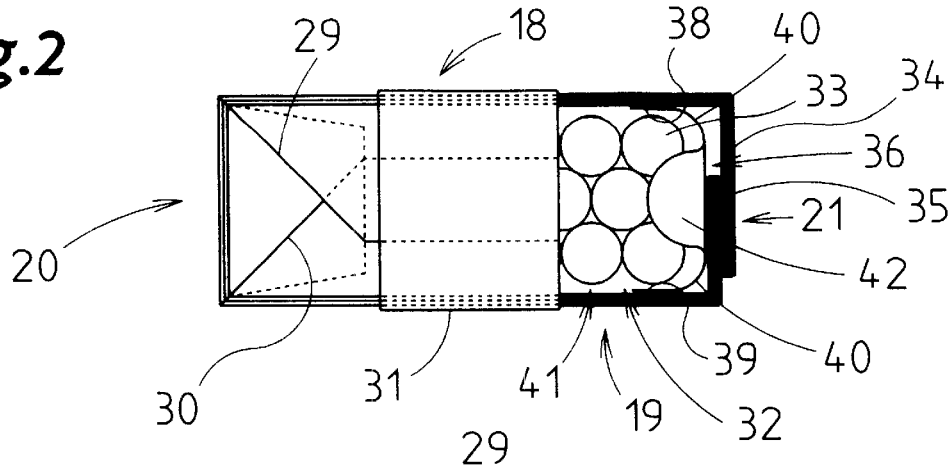
FIG. 2: the cigarette pack according to FIG. 1, in a top view.
Figure 3:
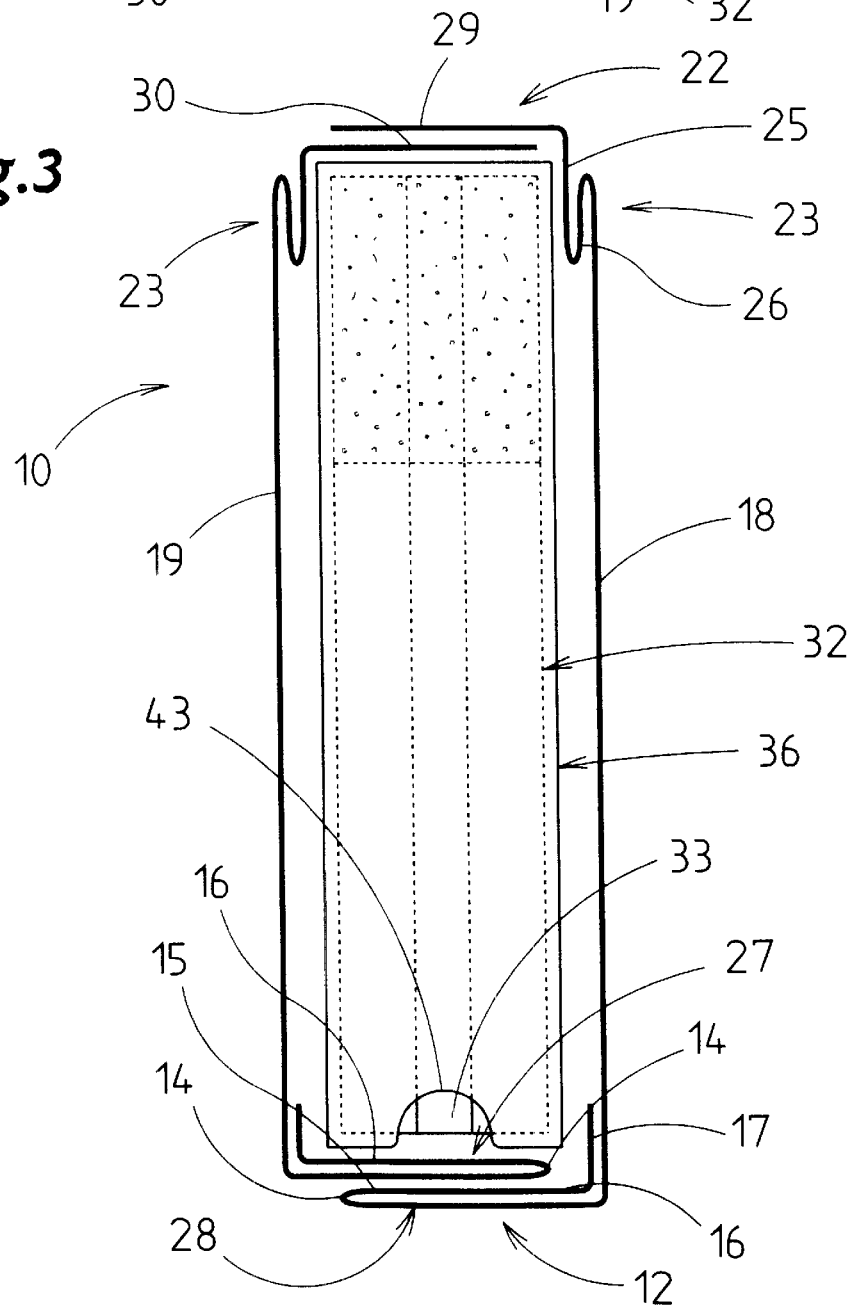
FIG. 3: a vertical cross-section of the cigarette pack directly in the area of an upright side wall.
Figures 4, 5:
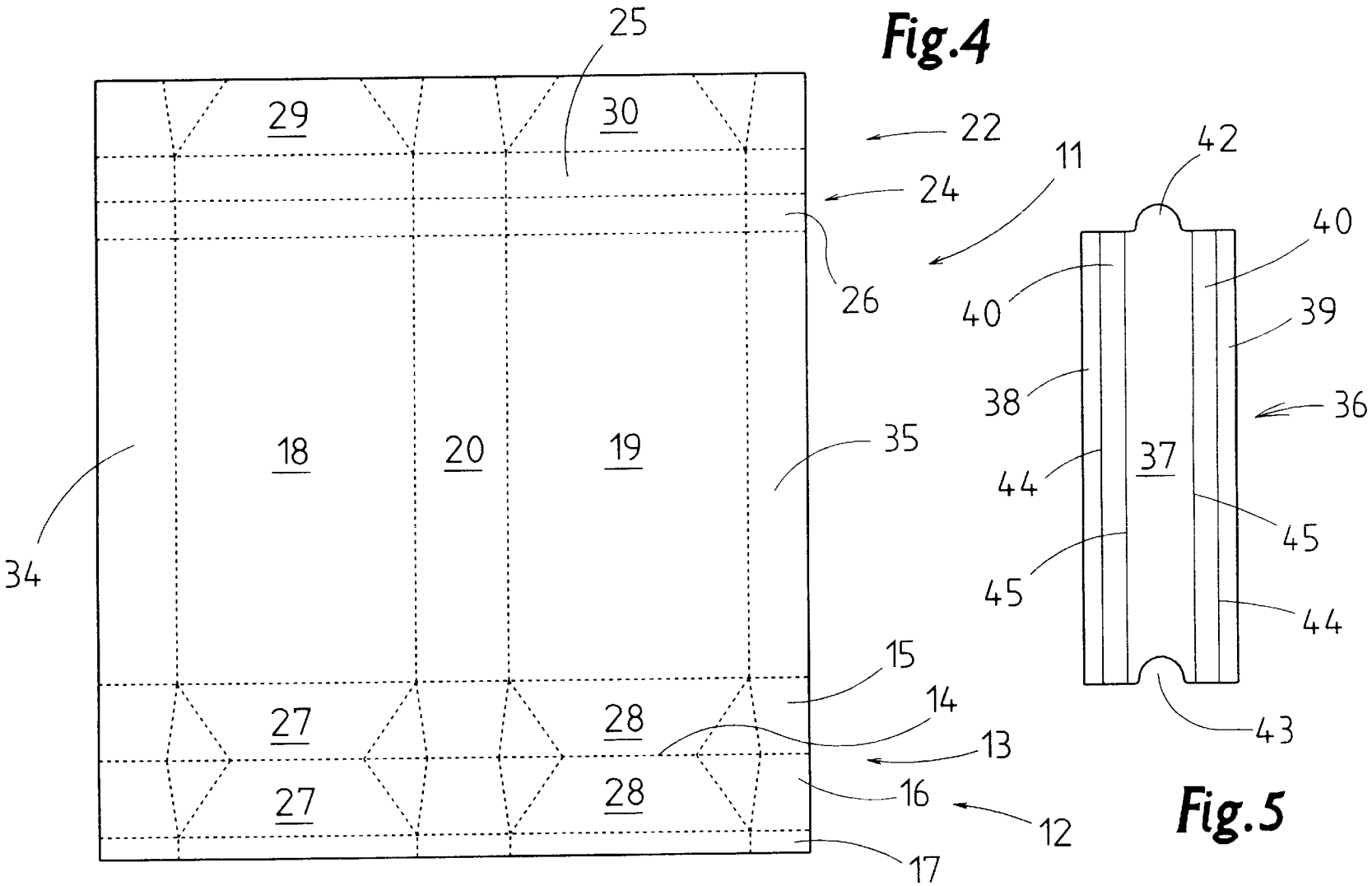
FIG. 4: a pack shape for a soft pack according to FIG. 1.
FIG. 5: a single cover shape for a pack according to FIG. 1 to 4.

The exemplary embodiments illustrated in the drawings relate to the design and manufacture of a special type of a (cigarette) pack 10. It comprises a single pack shape 11 (FIG. 4) of paper or comparable packaging material. The speciality of pack shape 11 and a therefrom produced pack lies in that areas of bottom wall 12 or of double-layered design. For this purpose, pack shape 11 has at the bottom edge a shape strip 13 which is folded along a folding line into a double-layered position. Two bottom strips 15, 16 abut each other. Edge strip 17 at the free edge of pack shape 11 is folded into an upright position and extends at the inside in the area of front wall 18, rear wall 19 and side walls 20, 21.

In the area of a top end wall 22, pack shape 11 or pack 10 also has a reinforcement composed of the one piece pack shape 11. This is a peripheral fold, i.e. Z-fold 23, directly below end wall 22 in the area of front wall 18, rear wall 19 and side walls 20, 21. Z-fold 23 is formed of folding strip 24 of pack shape 11 with internal folding shanks 25, 26.

The reinforcements of pack shape 11, i.e. double-layered design of bottom wall 12 as well as Z-fold 23 are stabilised by gluing sections together. Bottom strips 15, 16 can also be joined together by glue (glue spots), and folding shanks 25, 26 by glue spots as well.

Apart thereof, bottom wall 12 and end wall 22 are folded in a conventional manner, i.e. by forming trapezoidal bottom folding flaps 27, 28 on the one side and end folding flaps 29, 30 on the other side. These folding flaps 27, 28 as well as 29, 30 can also be joined together by gluing. In the area of end wall 22, a U-shaped folded adhesive tape 31 extends transversely over end folding flaps 29, 30 and serves as a seal. Apart thereof, pack 10 corresponds in its structure and manufacture with EP 649 797.

Pack shape 11 directly encases the pack contents, i.e. a group of cigarettes 32. Group of cigarettes 32 is composed of cigarettes 33 positioned in a plurality of layers, i.e. three layers. Group of cigarettes 32 is a virtually squareshaped block which is encased by pack shape 11 in such a manner that in the area of side wall 21 edge strips 34, 35 (partially) cover each other for the purpose of establishing side wall 21. Edge strips 34, 35 are joined in the cover area by gluing, for example by a row of glue spots.

In order to prevent glue being discharged in the gluing area of folding flaps of pack shape 11 or surplus glue from making contact with cigarettes 33, protective measures are provided, i.e. a cover for cigarettes 33 in the area of anticipated discharge of glue. In the present exemplary embodiment, a protective measure is provided for cigarettes in the area of side wall 21 which is established by edge strips 34, 35.

The cover of cigarettes 33 in this area is composed of a separate cover shape 36. The latter consists of thin foldable material, in particular paper. Cover shape 36 is positioned within pack 10 between the pack contents, i.e. cigarette group 32, and pack shape 11 in the area of side wall 21. Cover shape 36 extends over the full height of pack 10, i.e. from bottom wall 12 to end wall 22. Cover shape 36 then abuts the inside of side wall 21.

For optimal cover of cigarette group 32 and for stable positioning of cover shape 36, the latter is cross-sectionally approximately U-shaped, i.e. with a web 37 directly in the area of side wall 21 and with transversely oriented shanks 38, 39 in the area of front wall 18 and rear wall 19. The transition between shanks 38, 39 on the one hand and web 37 on the other hand is in the shape of a curvature 40 to approximately match the contour of cigarettes 33.

Cover shape 36 is designed or positioned in such a manner that it is easily removed when a still full pack 10 is opened. Packs 10 of the present type (soft pack or soft box pack) have a section in end wall 22 along adhesive tape 31 removed by severing, thus establishing thereat a dispensing opening 41. In this area is located cover shape 36 which protrudes sectionally from dispensing opening 41, in the present case with a tongueshaped flap 42. The latter is designed as an extension of cover shape 36 and extends with pack 10 dosed along the plane of end wall 22 whilst abutting the end surfaces of cigarettes 33. When pack 10 is opened, cover shape 36 can be grabbed on flap 42 and pulled upwardly out of pack 10.

Cover shape 36 is preferably manufactured on a continuous length of material by severing, and the transverse dimension corresponds with the width of the length of material. When severing along transversely oriented punched sections, flap 42 is formed on the one side, and opposite thereto is formed a corresponding recess 43. Cover shape 36 is then separated from the length of material without any losses. Furthermore, embossing lines 44, 45 are for practical reasons applied in the longitudinal direction of cover shape 36. They simplify folding over whilst forming shanks 38, 39.

Figure 6:
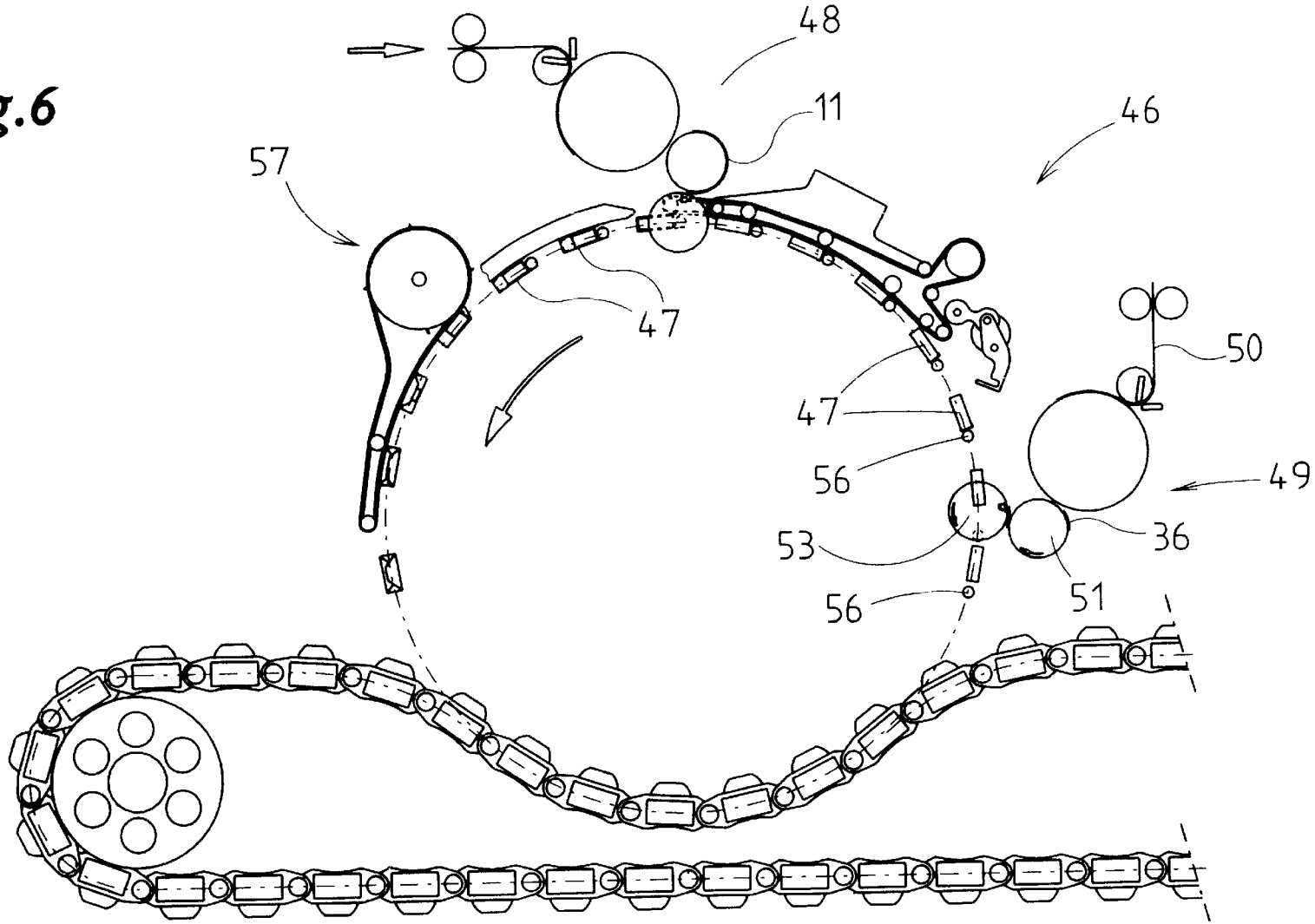
FIG. 6: a section of a packaging machine, i.e. a so-called soft packer, in a simplified side view.
Figure 7:
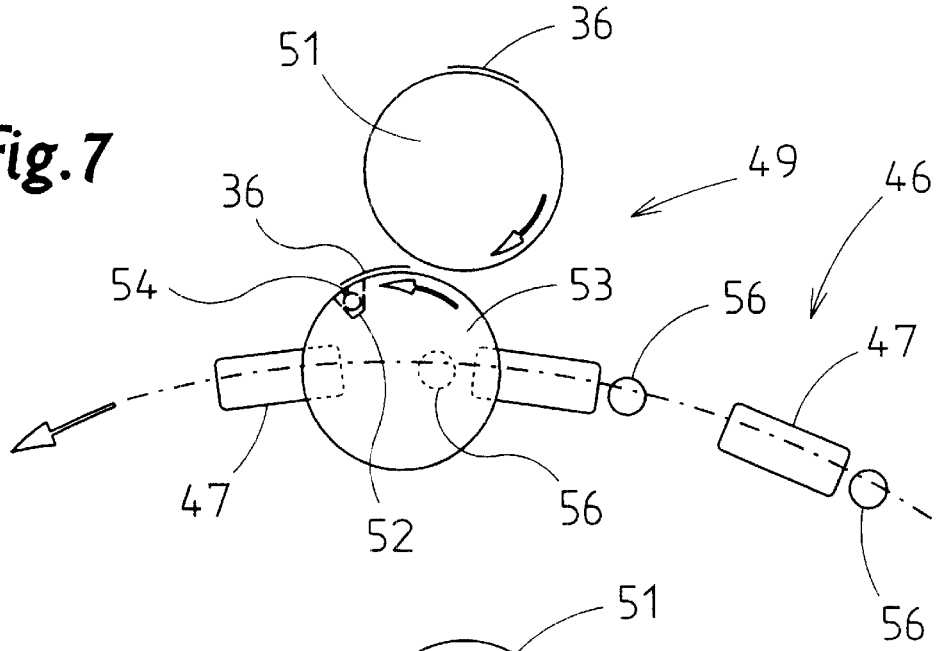
FIG. 7: a section of a folding revolver of the packaging machine according to FIG. 6, again simplified.

Pack 10 can be produced with a conventional or known packaging machine, in particular with a so-called soft packer. FIG. 6 diagrammatically illustrates a section of a packaging machine for manufacturing soft box packs. Further details of such a packaging machine are contained in DE 196 44 079.3.

The packaging machine comprises a folding revolver 46 which is along its periphery provided with a plurality of receptacles or holders for packs 10, i.e. with folding mandrels 47. These are elongated thin-walled hollow elements the (rectangular) cross-section of which corresponds with the cross-section of pack 10. Pack shape 11 is folded on the outside of the folding mandrel. Cigarette group 32 is guided over the inside of folding mandrel 47. A substantially finished pack 10 is, together with cigarette group 32, pushed off or out of folding mandrel 47.

Folding revolver 46 is along its periphery provided with a plurality of spatially fixed processing stations. A shape station 48 serves the delivery of pack shapes 11 to folding revolver 46 and to place pack shapes 11 on respectively associated folding mandrels 47. Shape station 48 is designed according to DE 196 44 079.3. Accordingly, pack shape 11 is placed against a (narrow) transverse wall of folding mandrel 47 located at the front, as seen in the rotary direction, and folded during continued movement.

Figure 8:
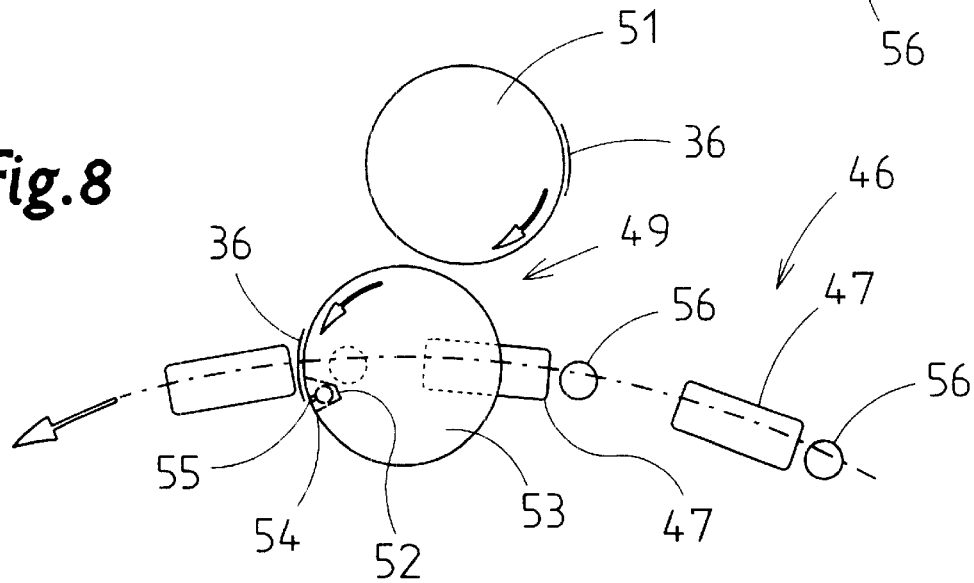
FIG. 8: the detail according to FIG. 7 with changed relative position.
Figure 9:
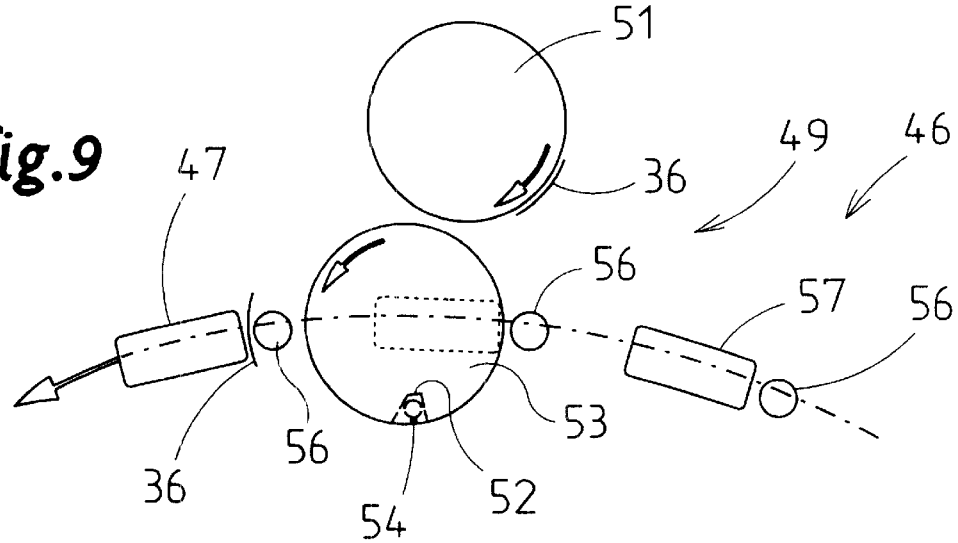
FIG. 9: a once again changed position of elements of FIG. 7 and FIG. 8.

As seen in the movement or rotary direction, shape station 48 is preceded by an additional shape station 49 which is of identical or similar design. In its area, cover shapes 36 are severed from a length of material 50 and transferred via a transfer roller 51 in the form of a suction roller to a rod- or fingershaped transfer element 52. The latter is arranged singlesidedly lipped on the circumferencial area of a rotary driven support disc 53. Protruding transfer element 52 grabs delivered cover shape 36 at a curved outside surface 54 which fixes cover shape 36 by vacuum holes 55. Cover shape 36 is eccentrically fixed on transfer element 52 so that a predominant area of cover shape 36 extends at the rear, as seen in the rotary direction, over transfer element 52. Folding mandrels 47 are by rotation of folding revolver 46 moved passed the spatially fixed support disc whilst in a matched movement transfer element 52 is moved along a circular path through the movement path of folding mandrels 47. In a position according to FIG. 8, i.e. adjacent to the rear side of a passing folding mandrel, support disc 53 or transfer element 52 is stopped for a short while, i.e. in a position in which a delivery cover shape 36 is positioned centrally to folding mandrel 47. At this moment, a press-on element 56 is pressed from a retracted position against folding mandrel 47 which is positioned in front thereof as seen in the movement direction. Cover shape 36 is thus pushed against the rear of folding mandrel 47 and at the same time released from transfer element 52 by ventilation of vacuum bores 55. Cover shape 36 is then delivered, in a packaging correct position and whilst abutting folding mandrel 47, to shape station 48 where pack shape 11 is in a conventional manner laid around folding mandrel 47. Edge strips 34, 35 then extend along the rear of folding mandrel 47, i.e. in the area of cover shape 36. In the further course, edge strips 34, 35 are folded by folding elements in the area of folding station 57 against the rear of folding mandrel 47 or against cover shape 36. On completion of pack 10 and delivery of cigarette group 32, this is together with pack 10 pushed off folding mandrel 47.

Cover shape 36 can take over an additional function, i.e. as a print carrier for advertising messages, as a voucher for participation in raffles, competitions etc. Furthermore, cover shape 36 can be placed by a different method in the described position within pack 10, for example by positioning within folding mandrel 47. In this case, cigarette group 32 and cover shape 36, which is positioned in a packaging correct position, are jointly pushed out of folding mandrel 47.

According to a further alternative, the cover shape can be integrally joined with pack shape 11. It is also possible to position cover shapes of analog design in other areas by way of glued folding flaps, for example in the area of bottom wall 12 and/or end wall 22.

What is claimed is:

1. A soft pack for cigarettes, comprising a body (11) which directly encases a group (32) of cigarettes (33), wherein the body (11) comprises, in an area of at least one upright side wall (21) of the soft pack (10), folding flaps or edge strips (34, 35) which are glued together, characterised in that in an area of the folding flaps or the edge strips (34, 35), which are glued together, between the cigarette group (32) and the body (11), is arranged a cover element to protect the cigarettes (33) from glue;

in that the cover element (36) is folded in the shape of a U, around a lateral area of the cigarette group (32), oriented towards the side wall (21), and extends over the entire height of the pack (10); and in that the cross-sectionally U-shaped folded cover element (36) comprises between a web (37), which abuts the side wall, and shanks (38, 39) which are oriented transversely thereto, a curvature (40) corresponding to the shape of the cigarettes (33).

2. The pack according to claim 1, characterised in that the cover element is designed as a separate element (36) of thin material.

3. A soft pack for cigarettes, wherein:

a) a cigarette group (32) is directly encased as the pack's contents by a pack body (11) made of a thin material such that the cigarettes (33) abut the pack body (11);

b) the pack body (11) has, in a region of at least one upright side wall (21), folding flaps or edge strips (34, 35) which are glued together;

c) in a region of the folding flaps or edge strips (34, 35) which are glued together, a covering is arranged between the cigarette group (32) and the pack body (11) to protect the cigarettes (33) from glue;

d) the covering is a separate cover element (36) of thin material and is separate from the pack body (11); and e) the cover element (36) extends at least in a region of the side wall (21) between the side wall and the cigarette group (32).

4. The soft pack according to claim 3, wherein the cover element (36) is folded in the shape of a U, around a lateral region of the cigarette group (32), facing the side wall (21), and extends across the entire height of the pack (10).

5. The soft pack according to claim 3, wherein the cover element (36) has, in a region of a pack end wall (22), a tongue-like flap (42) which, when a dispensing opening (41) has been made in a region of the end wall (32), is exposed for gripping the cover element (36).

6. The soft pack according to claim 3, wherein:

a) the cover element (36) is folded in a U-shape, around a lateral region of the cigarette group (32), oriented toward the side wall (21);

b) a center web (37) of the cover element (36) extends directly in a region of the side wall (21);

c) transverse shanks (38, 39), connected to the web (37), extend in a region of a pack front wall (18) and a pack rear wall (19);

d) arranged in a region of the web (37), as an extension of the cover element (36), is a tongue-shaped flap (42) which extends in a plane of a pack end wall (22) when the pack (10) is closed;

e) the flap (42) is located in a region of a cigarette dispensing opening (41) to be made in the end wall (22) such that, after the dispensing opening (41) has been made, the flap is exposed for gripping and pulling out the cover element (36); and f) the cover element (36) extends over the entire height of the pack (10).

7. The soft pack according to claim 4, wherein the cover element, folded in the U-shape, has a curvature (40), corresponding to the shape of the cigarettes (33), between a web (37), which abuts the side wall (21), and shanks (38, 39) directed transversely thereto.

* * * * *